US005220794A

United States Patent [19]

Sledd et al.

[11] Patent Number: 5,220,794

[45] Date of Patent: Jun. 22, 1993

[54] IMPROVED FUEL INJECTOR FOR A GAS TURBINE ENGINE

[75] Inventors: Michael W. Sledd, Vista; Jack R. Shekleton, San Diego, both of Calif.

[73] Assignee: Sundstrand Corporation, Rockford, Ill.

[21] Appl. No.: 542,739

[22] Filed: Jun. 22, 1990

Related U.S. Application Data

[63] Continuation-in-part of Ser. No. 283,070, Dec. 12, 1988, Pat. No. 4,967,563.

[51] Int. Cl.[5] ..... F23R 3/20

[52] U.S. Cl. ..... 60/737; 60/743

[58] Field of Search ..... 60/737, 738, 743, 39.826, 60/740; 123/531; 239/423, 424, 432, 523, 533.12

[56] References Cited

U.S. PATENT DOCUMENTS

| | | | |
|---|---|---|---|
| 2,706,520 | 4/1955 | Chandler | 60/739 |
| 3,099,134 | 7/1963 | Calder et al. | 60/746 |
| 3,142,961 | 8/1964 | Carlisle | 60/743 |
| 3,283,502 | 2/1965 | Lefebvre . | |
| 3,353,351 | 11/1967 | Bill et al. | 60/743 |
| 4,798,190 | 1/1989 | Vaznaian | 239/423 |
| 4,815,665 | 3/1989 | Haruch | 239/432 |
| 4,967,563 | 11/1990 | Shekleton | 60/743 |
| 4,989,404 | 2/1991 | Shekleton | 60/743 |
| 5,027,603 | 7/1991 | Shekleton et al. | 60/743 |

FOREIGN PATENT DOCUMENTS

| | | |
|---|---|---|
| 197806 | 11/1976 | Fed. Rep. of Germany . |
| 8905903 | 6/1989 | World Int. Prop. O. . |

*Primary Examiner*—Richard A. Bertsch
*Assistant Examiner*—Timothy S. Thorpe
*Attorney, Agent, or Firm*—Wood, Phillips, VanSanten, Hoffman & Ertel

[57] ABSTRACT

The high cost of fuel injection nozzles for a gas turbine engine may be reduced by utilizing nozzles (60) formed of simple tubes (63) of capillary cross section having an integral flange (62) formed on one end (86) thereof.

9 Claims, 2 Drawing Sheets

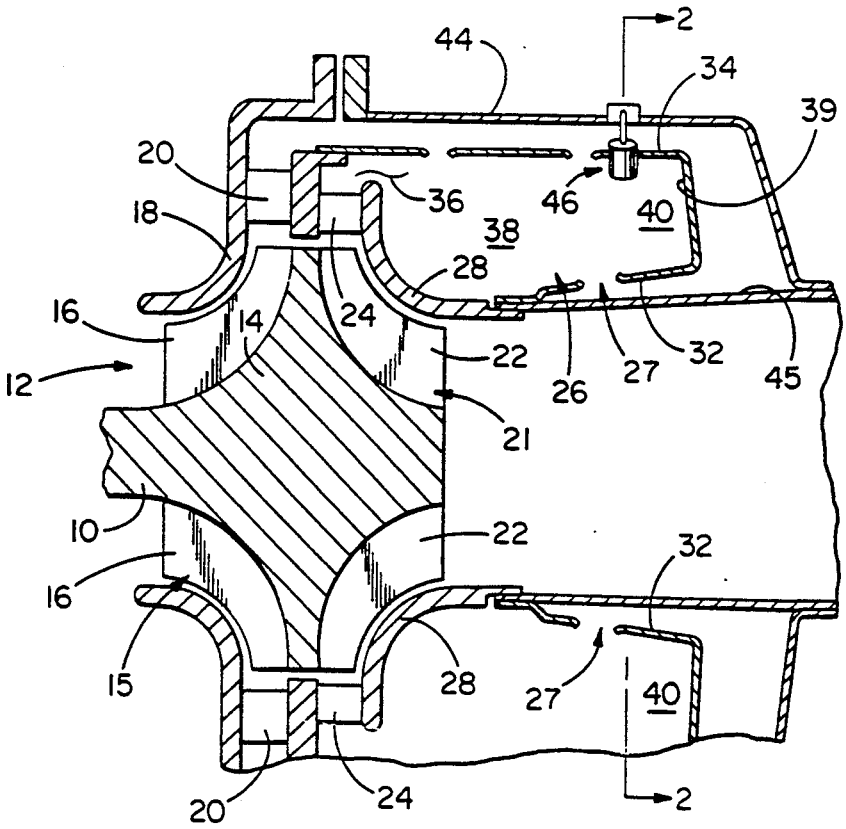
FIG. 1
FIG. 2
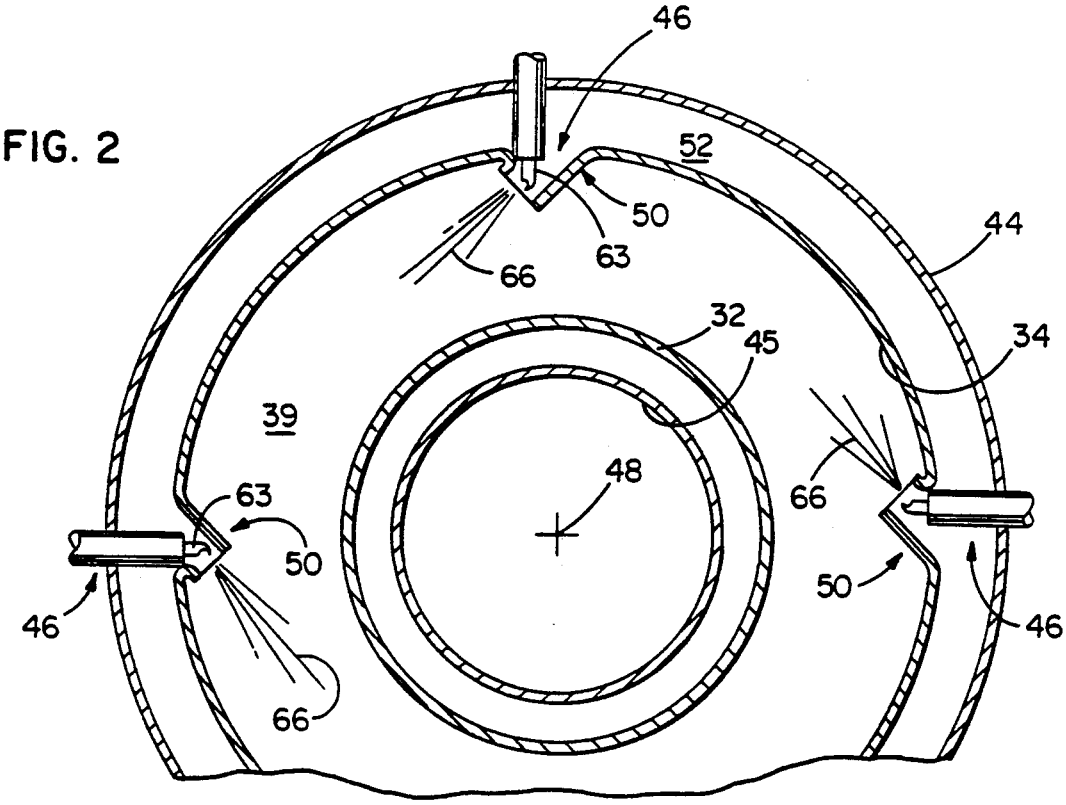

IMPROVED FUEL INJECTOR FOR A GAS TURBINE ENGINE

CROSS REFERENCE

This application is a continuation-in-part of commonly assigned, co-pending application of Jack R. Shekleton, Ser. No. 283,070, filed Dec. 12, 1988 now U.S. Pat. No. 4,967,563 and entitled "Turbine Engine With High Efficiency Fuel Atomization".

FIELD OF THE INVENTION

This invention relates to gas turbine engines, and more particularly, to gas turbine engines provided with inexpensive, high efficiency fuel atomizing fuel injectors to enhance reliability.

BACKGROUND OF THE INVENTION

In relatively small turbine engines in airborne environments, fuel flows at high altitudes, particularly during starting of the turbine engine, are frequently quite low. Consequently, fuel injectors requiring high fuel pressures are commonly used to achieve pressure atomization of the fuel.

However, at low turbine speeds, it is difficult with available fuel pumps to generate the necessary fuel pressure. Further, at such low speeds, the engine compressor will not be delivering a large volume of compressed air and the atomization assists resulting from air blast atomization of fuel is unavailable. By way of example, in a typical worst case, the pressure drop across the combustor is about one inch of water which ordinarily is insufficient to provide acceptable fuel atomization.

To meet these difficulties, conventional injectors have extremely small orifices to provide the desired atomization, making them precision formed parts. They are thus costly to manufacture. At the same time, because of the very small orifices employed, they are prone to plugging, a factor that clearly detracts from reliability. Where lower pressure atomizing fuel injectors are used with viscous fuels, high losses occur which reduce atomization efficiency and atomization is frequently unsatisfactory.

In the above identified, co-pending application, a new and improved fuel injector overcoming one or more of the above problems is proposed. At the same time, further improvements are always welcome and the present invention relates to a fuel injector for a gas turbine engine that is improved over the construction disclosed in the copending application as well as a method of fabricating such a fuel injector.

SUMMARY OF THE INVENTION

It is a principal object of the invention to provide a new and improved gas turbine engine More specifically, it is an object of the invention to provide a new and improved fuel injector for a turbine engine which provides excellent fuel atomization adequate to provide reliable starting at low fuel flows such as occur, for example, at high altitudes, as well as a method of economically making such a fuel injector.

An exemplary embodiment of the invention, according to one facet thereof, achieves the foregoing object in a gas turbine engine, including a rotatable turbine wheel, an annular combustor located about the turbine wheel and including an annular combustion space, a nozzle disposed about the turbine wheel and extending between the same and the combustor to direct gases of combustion from the combustor to drive the turbine wheel and a plurality of spaced air blast tubes extending into the combustor and having exit ends at locations remote from the nozzle. Fuel injectors are provided for at least some of the air blast tubes and each comprises a simple tube of capillary cross section having an open end within the corresponding air blast tube near the exit end thereof and an integral flange at the open end and intersecting the path of fuel therefrom and angled toward the annular combustion space.

In a preferred embodiment, the air blast tubes and the integral flanges of the fuel injectors are all angled generally tangentially or circumferentially to the annular combustion space.

In a preferred embodiment of the invention, the tube has coaxial inner and outer walls. In a highly preferred embodiment, the tube has a cylindrical outer wall and an interior wall defining a flow path of cylindrical shape.

The invention contemplates that the integral flange includes part of the outer wall.

The invention also contemplates that the integral flange includes part of the interior wall.

Preferably, one side of the flange is defined by part of the interior wall and the other side of the flange is defined by the outer wall.

According to another facet of the invention, there is provided a method of making a fuel injector system for a gas turbine engine having a combustor defining a combustion space which includes the steps of (a) locating at least one open ended air blast tube in the combustor so that an exit end thereof is in the combustion space, (b) forming a flange on an open end of a simple tube having a capillary cross section such that the flange extends across the axis of the tube at an acute angle without closing the open end thereof, and (c) mounting the simple tube to the combustor so that the open end is within the air blast tube near the exit end thereof with the flange being directed generally toward the combustion space.

In a highly preferred embodiment, the combustor is an annular combustor having inner and outer walls and the air blast tubes are located in the outer wall.

The invention contemplates, in a highly preferred embodiment, that step (b) be performed by making a transverse cut partially across the simple tube from one side thereof, making a diagonal cut partially across the simple tube from the other side thereof such that the cuts intersect one another, and bending the resulting projection across the axis of the simple tube to define the flange.

In one embodiment, step (b) may also include the step of flattening the flange where the tube is, for example, of cylindrical shape.

Other objects and advantages will become apparent from the following specification taken in connection with the accompanying drawings

DESCRIPTION OF THE DRAWINGS

FIG. 1 is a somewhat schematic, sectional view of a gas turbine engine embodying the invention;

FIG. 2 is a sectional view taken approximately along the line 2—2 in FIG. 1;

DESCRIPTION OF THE PREFERRED EMBODIMENT

Figure 3:
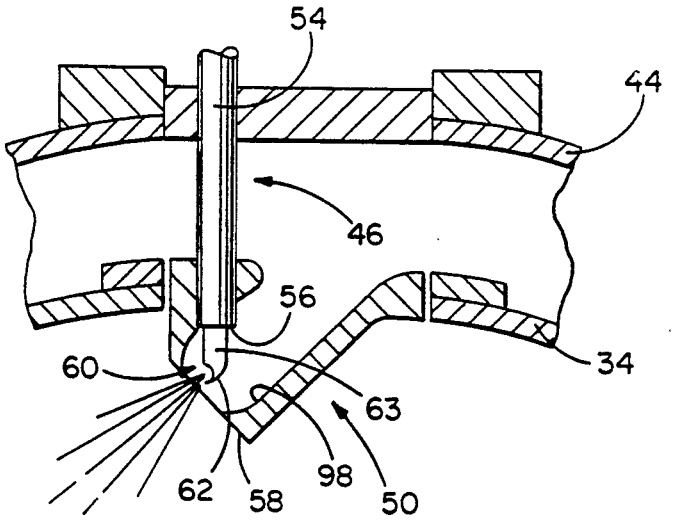
FIG. 3 is an enlarged, fragmentary view of an air blast tube and associated fuel injector utilized in the invention.

An exemplary embodiment of the gas turbine made according to the invention is illustrated in the drawings in the form of a radial flow, air breathing gas turbine. However, the invention is not limited to radial flow turbines and may have applicability to any form of air breathing turbine, particularly, but not necessarily, those utilizing an annular combustor.

The turbine includes a rotary shaft 10 journaled by bearings not shown. Adjacent one end of the shaft 10 is an inlet area where air is to be compressed. The shaft 10 mounts a rotor, generally designated 14, which may be of conventional construction. Accordingly, the same includes a centrifugal compressor, generally designated 15, including a plurality of compressor blades 16 adjacent the inlet 12. A compressor shroud 18 is provided in adjacency thereto and just radially outwardly of the radially outer extremities of the compressor blades 16 is a conventional diffuser 20.

Oppositely of the compressor blades 16, the rotor includes a conventional turbine wheel, generally designated 21, including a plurality of turbine blades 22. Just radially outward of the turbine blades 22 is an annular nozzle 24 which is adapted to receive hot gasses of combustion along with dilution air as, for example, from an annular combustor, generally designated 26. The compressor 15, including the blade 16, the shroud 18, and the diffuser 20 deliver compressed air to the annular combustor 26, and via dilution air passages 27, to the nozzle 24 along with gases of combustion generated within the combustor 26. That is to say, hot gases of combustion from the combustor are directed via the nozzle 24 against the blades 22 to cause rotation of the rotor 14 and thus the shaft 10. The latter may be, of course, coupled to some sort of apparatus requiring the performance of use for work. Alternatively, the output from the turbine may be in the form of thrust.

A rear turbine shroud 28 is interfitted with the combustor 26 to contain gases against the turbine blades 22. The combustor 26 has a generally cylindrical inner wall 32 and a generally cylindrical outer wall 34. The two are concentric with each other about the rotational axis of the shaft 10 and merge to a necked down area 36 which serves as an outlet from an interior annulus 38 defined by the space between the walls 32 and 34 of the combustor 26. The outlet 36 is, of course, in fluid communication with the nozzle 24.

A third wall 39, generally concentric with the walls 32 and 34 extends generally radially to interconnect the walls 32 and 34 and to further define the annulus 38.

Opposite of the outlet 36 and adjacent the wall 39, the interior annulus 38 of the combustor includes a primary combustion zone 40 in which the burning of fuel primarily occurs. The primary combustion zone 40 is an annulus or annular space defined by the generally radially inner wall, the radially outer wall 34 and the radially extending wall 39. Other combustion may, in some instances, occur downstream from the primary combustion zone 40 in the direction of the outlet 36 and in some instances, provision may be made for the dilution air to flow entirely about the combustor 26 rather than enter the interior of the same through the passages 27.

A further annular wall 44 is generally concentric with the walls 32 and 34 and is located radially outward of the latter. Similarly, an inner annular wall 45 inside the wall 32 is provided and together with the wall 44 provides a plenum surrounding the combustor 26 to confine the compressed air from the compressor 12.

Mounted on the wall 44, and extending through the wall 34, are main fuel injectors, generally designated 46. As seen in FIG. 2, according to a preferred embodiment of the invention, there are a plurality of the injectors 46, namely, in the particular instance shown, four that are preferably equally angularly spaced about the axis of the rotation of the shaft 10 which is designated by a point 48. Associated with each injector 46 is an air inlet port or air blast tube, generally designated 50. Each air blast tube 50 is in fluid communication with the space 52 between the walls 34 and 44 which serves as a manifold or plenum for compressed air received from the compressor 15 and which is utilized to support combustion within the combustor 26.

The air blast tubes 50 are elongated and generally cylindrical in configuration. The cylindrical axis of each is generally tangential (or circumferential) to the combustion space defined by the walls 32 and 34 and generally speaking, the axis of each of the air blast tubes 50 will be in a single plane that is transverse to the rotational axis 48. However, it is to be understood that in some instances, axial spacing of the air blast tubes 50 may be desired.

As best seen in FIG. 3, each of the injectors 46 includes a tubular fuel conduit 54 terminating at an end 56 near the exit end 58 of the corresponding air blast tube 50. Mounted in the end 56 of the conduit 54 is a fuel injection nozzle, generally designated 60, made according to the invention. It is to be noted that the nozzle 60 includes a flange 62 located to be generally tangential (or circumferential) to the annular combustion space 40. Consequently, fuel injection will be generally in the area represented by streams 66 appearing in FIG. 2, although such streams will not actually appear because of atomization of the fuel during turbine operation.

Figure 4:
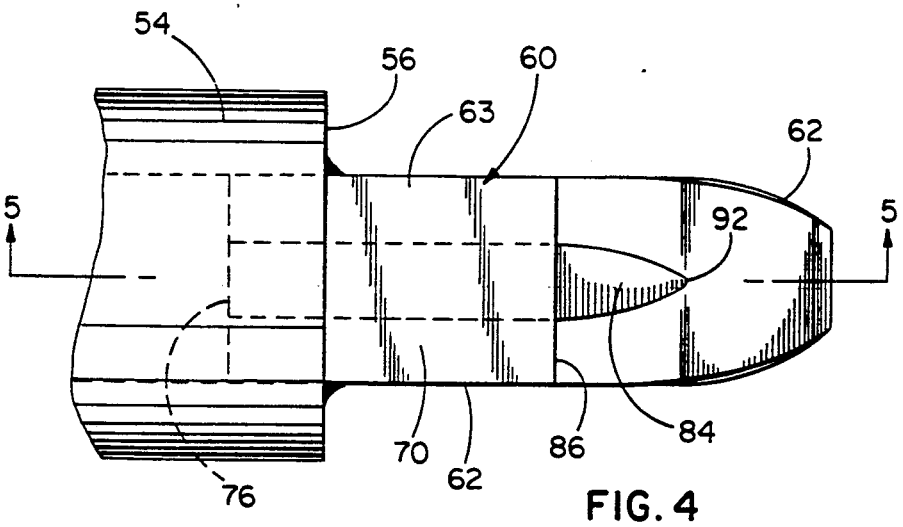
FIG. 4 is an enlarged, fragmentary view of a fuel injector made according to the invention from the top thereof.
Figure 5:
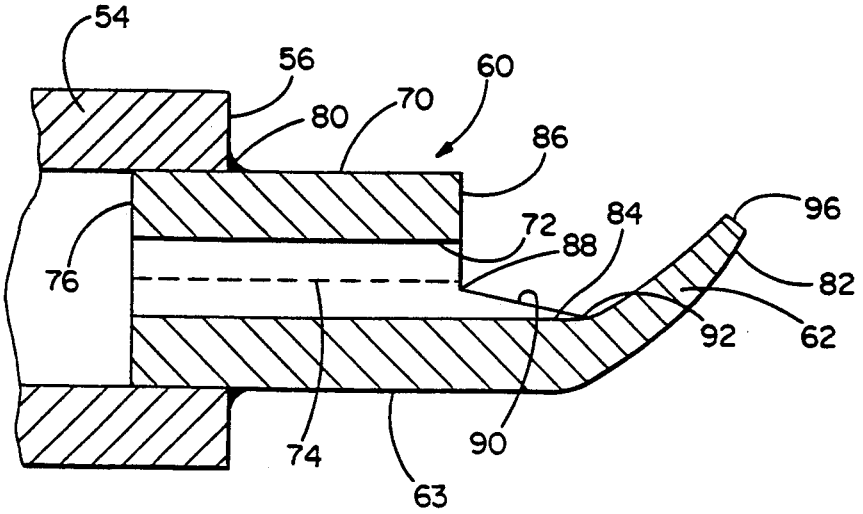
FIG. 5 is a sectional view of the fuel injector taken approximately along the line 5—5 in FIG. 4.

Turning now to FIGS. 4 and 5, the fuel injecting nozzles 60 will be described in greater detail. Each is in the form of a simple tube of capillary cross section, that is, a capillary tube 63. As used herein, the term "capillary tube" is used in the conventional sense, that is, as defined in the Dictionary of Scientific and Technical Terms, published by McGraw-Hill Book Company of New York, N.Y., Copyright 1974. The term "simple tube" as used herein is intended to refer to conduits or the like that are normally considered tubes and which are formed by conventional tube forming methods as opposed to expensive and precision machining operations as are conventionally employed in the formation of pressure atomizing nozzles. Typically, both the outer wall 70 and interior wall 72 of each such tube 63 will be concentric about an axis 74 and usually, but not always, will be of cylindrical configuration. The end 76 of each nozzle 60 opposite from the flange 62 is disposed within the end 56 of the fuel conduit 54 and brazed in place as by brazing 80.

The flange 62 is an integral part of the capillary tube 63 and includes one surface 82 which is part of the outer wall 70 of the capillary tube 63 and an opposite surface 84 which is part of the interior wall 72. The flange 62 is formed integrally on the capillary tube 63 as follows. A first cut is made transverse to the axis 74 from one side of the capillary tube to provide the end or edge designated 86 in FIGS. 4 and 5. The cut forming the edge 86 is taken just past the axis 74 of the capillary tube 63.

A second cut is made diagonally from the diametrically opposite side of the tube so as to intersect the edge 86 at a point 88 The edge left by the diagonal cut is designated 90. At about the point 92 where the cut forming the edge 90 intersects the interior surface 72, the remaining part of the tube is bent upwardly as shown in FIG. 5 and squared off as illustrated at 96. The edges are left sharp and are deburred. The flange 62 is bent at an acute angle so as to extend across the axis 74 without closing the opened end of the capillary tube defined by the cuts producing the edges 86 and 90.

In some instances, the flange 62 may be flattened while in other instances, it may be slightly curved. The shape of the flange 62 in this respect will control the spray path, that is, a flat flange 62 will provide a flat spray while a curved one will provide a somewhat curved spray.

It is significant that the orifice that is defined by the edges 86 and 90 merge smoothly with the flange 62. Thus, the interior 72 form part of one side of the flange 62. In operation, the nozzle 60 provides a film on the flange 62 that is broken up by the blast of air entering the combustor through the air blast tubes 50, even at very low pressure drops. By taking the cut defining the edge 86 past the center line or axis 74 of the tube, a uniform, narrow film like spray is obtained. If the cut is not taken past the axis 74, a maple leaf spray pattern may be obtained.

While the injector of the invention at least superficially resembles impingement injectors, it should be noted that true impingement atomization is not occurring. In an impingement injector, there is a free, unrestrained, flow of fuel between an orifice and a flange and fuel impacts upon the flange after flowing freely and splatters as a result. In the operation of the injector of the present invention, the fuel is always attached, at least in part, to some part of the nozzle during its path from the edge 86 to the flange 62 and this results in the generation of the aforementioned film which in turn is broken up by the air blast as the film flows off the edges of the flange 62.

It is preferred to locate the nozzles 60 closely adjacent the exit ends 58 of the air blast tubes 50. However, this is not a completely necessary requirement, although such a location does provide the best atomization. It is also noted that improved atomization is achieved when the ends 58 converge somewhat as illustrated at 98 in FIG. 3.

In instances where high pressure drops in the fuel flow are not of concern, it is possible that the conduits 54 be done away with and a continuation of the capillary tube forming each nozzle 50 utilized as a fuel flow conduit. Generally, however, high fuel flow pressure drops are undesirable with the result that the length of the capillary tube between the end 76 and the edge 86 should desirably remain relatively short.

From the foregoing, it will be appreciated that fuel injectors made according to the invention made be made relatively inexpensively and without the great degree of precision required in pressure atomization type injectors. One need only employ a simple tube of capillary cross section and make the aforementioned cuts and perform the bending operation, with or without flange flattening, to obtain a relatively inexpensive highly efficient fuel injector.

We claim:

1. A gas turbine engine including:

a rotatable turbine wheel;

an annular combustor located about said turbine wheel and including an annular combustion space;

a nozzle disposed about said turbine wheel and extending between the same and said combustor to direct gases of combustion from said combustor to drive said turbine wheel;

a plurality of spaced air blast tubes extending into said combustor and having exit ends oriented generally circumferentially to said annular combustion space at locations remote from said nozzle; and fuel injectors for at least some of said air blast tubes, each comprising a simple tube of capillary cross section having an open end within the corresponding air blast tube near the exit end thereof, and an integral projection at said open end and bent to intersect the path of fuel flowing therefrom and angled generally tangentially to said annular combustion space.

2. The gas. turbine engine of claim 1 wherein said simple tubes have upstream ends opposite said open ends, and said upstream ends are mounted in sealed relation to fuel conduits.

3. A gas turbine engine including:

a rotatable turbine wheel;

an annular combustor located about said turbine wheel and including an annular combustion space;

a nozzle disposed about said turbine wheel and extending between the same and said combustor to direct gases of combustion from said combustor to drive said turbine wheel;

a plurality of spaced air blast tubes extending into said combustor and having exit ends oriented generally circumferentially to said annular combustion space at locations remote from said nozzle; and a fuel injector for at least one of said air blast tubes, comprising a simple tube of capillary cross section having an open end within the corresponding air blast tube, and an integral flange at said open end and intersecting the path of fuel flowing therefrom and angled generally tangentially to said annular combustion space, said integral flange being defined by a transverse cut extending partially across said simple tube from one side thereof and a diagonal cut extending partially across said simple tube from the other side thereof, said cuts intersecting one another, and a bend in the resulting projection to cause the projection to extend across the axis of said simple tube.

4. A gas turbine engine including:

a rotatable turbine wheel;

an annular combustor located about said turbine wheel and including an annular combustor space;

a nozzle disposed about said turbine wheel and extending between the same and said combustor to direct gases of combustion from said combustor to drive said turbine wheel;

a plurality of spaced air blast tubes extending into said combustor and having exit ends at locations remote from said nozzle; and fuel injectors for at least some of said air blast tubes, each comprising a simple tube of capillary cross section having an open end within the corresponding air blast tube, and an integral flange formed of part of said simple tube at said open end and intersecting the path of fuel flowing therefrom and angled toward said annular combustion space.

5. The gas turbine engine of claim 4 wherein said simple tube has a cylindrical outer wall, and an interior wall defining a flow path of cylindrical shape.

6. The gas turbine engine of claim 5 wherein said interior wall and said outer wall are coaxial.

7. The gas turbine engine of claim 6 wherein said integral flange includes part of said outer wall.

8. The gas turbine engine of claim 6 wherein said integral flange includes part of said interior wall.

9. The gas turbine engine of claim 6 wherein one side of said integral flange is defined by part of said interior wall and the other side of said integral flange is defined by part of said outer wall.

* * * * *